US006378151B1

(12) United States Patent
Lowe

(10) Patent No.: US 6,378,151 B1
(45) Date of Patent: Apr. 30, 2002

(54) BABY CRIB SLEEP AID

(76) Inventor: Kristen M. Lowe, 4434 Newton Ave. North, Minneapolis, MN (US) 55412

( * ) Notice: Subject to any disclaimer, the term of this patent is extended or adjusted under 35 U.S.C. 154(b) by 0 days.

(21) Appl. No.: 09/855,083

(22) Filed: May 16, 2001

(51) Int. Cl.[7] ..... A47C 21/06
(52) U.S. Cl. ..... 5/660
(58) Field of Search ..... 5/660, 659, 731, 5/690, 655, 633, 652

(56) References Cited

U.S. PATENT DOCUMENTS 4,193,150 A * 3/1980 Vineberg ..... 5/633
5,771,515 A 6/1998 Carr ..... 5/660

OTHER PUBLICATIONS

Safe Lift Crib Wedge, DEX Products, 601 Stone Rd., Benica, CA, 94510—From Web Page: dexproducts. com.

* cited by examiner

*Primary Examiner*—Alexander Grosz
(74) *Attorney, Agent, or Firm*—Robert E. Lowe

(57) ABSTRACT

A device for elevating the head of a baby in a crib comprising a wedge divided into a plurality of parallel spaced apart sections adapted to fit between the vertical bars of a crib and under the crib mattress to raise one end of the mattress an amount substantially equal to the height of the wedge.

5 Claims, 1 Drawing Sheet

BABY CRIB SLEEP AID

BACKGROUND OF THE INVENTION

Physicians frequently recommend that babies who are suffering from colds or other forms of head congestion sleep with their head slightly elevated. However, this is often easier said than done. Modern baby cribs are not generally well suited to modification of the sleeping position, which is generally horizontal and flat. (As used herein, the term "baby" is intended to encompass both infants and toddlers, children under the age of about three or four who most often sleep in cribs designed for the safe sleep of babies.)

A common recommendation for achieving an elevated head position is to place some books under the head end of the crib mattress. This rather crude approach is often difficult to accomplish and can yield a wide variety of results as little guidance is given as to how high the end should be raised, and judgment can vary from one person to another. Moreover, modem crib design demands that the crib mattress fit snugly into the crib with little of no gap between the mattress and the side or ends of the crib. This tight fit is deemed necessary to prevent trapping hazards to the baby, but it also can make the mattress difficult to grasp and raise in order to insert the books or other objects under the mattress. Therefore, home expedients such as books under the mattress are awkward at best and potentially unreliable.

It is known that infants born prematurely often suffer from serious breathing problems that require that they are maintained at a fairly steep angle of head-raised incline, generally prescribed as an angle of thirty degrees. Devices having an incline of thirty degrees are available and designed so that the entire body of the infant is placed onto the inclined plane of the device. Because the angle is quite steep, it is necessary to provide some means for holding the infant in place and prevent their rolling off. This has been accomplished through the use of side barriers, straps, etc. The device of the present invention is not intended for use in such cases, nor does it provide sufficient inclination for such treatment, but rather is designed to raise the head of the baby slightly above the remainder of the body.

It is generally believed and recommended that the inside of a baby crib be kept as free as possible of extraneous loose objects that could in any way present a smothering, choking, trapping, or other danger to the baby. It is therefore generally not desirable to introduce pillows or other sleeping devices directly into the crib sleeping space. Moreover, there is always a potential for soiling any device or object that is used in a manner in which it comes into direct contact with the baby.

The present invention overcomes the limitations of the prior art devices and provides a safe and simple means for elevating the head end of a crib mattress to assist a baby suffering from head congestion to achieve safe and restful sleep.

SUMMARY OF THE INVENTION

The present invention an easy to use device that can be easily inserted under the head end of the crib mattress to elevate a baby's head as necessary. The device does not require removal of the mattress to be inserted, and is not placed inside the crib sleeping area, but rather is inserted under the mattress where it can present no hazard to the baby in the crib. Insertion and removal of the device is sufficiently simple that it can actually be accomplished while the baby is already in the crib if desired with very little, if any, disruption of the baby.

The device includes a generally wedge shaped, multi-tined fork like structure having sufficient rigidity and strength to be inserted from outside the head end of the crib directly under the crib mattress. The individual tines or fingers of the device are spaced apart in a manner to correspond with the width of the vertical bars of the crib, thus allowing the fingers to slip between the crib bars and under the mattress. The width of the individual tines is chosen to be slightly narrower than the space between the individual vertical bars of the crib, thereby providing as much width and strength as possible while allowing the device to be inserted from outside the crib.

DESCRIPTION OF PREFERRED EMBODIMENTS

Figure 1:
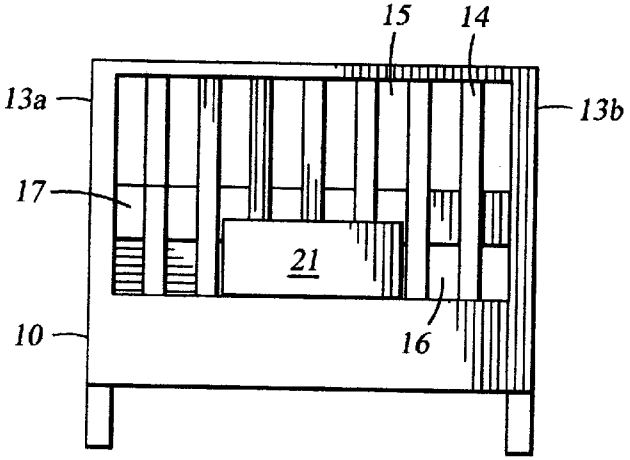
FIG. 1 is an end view of a baby crib and the present device showing the device inserted under the crib mattress.

With reference to the drawings and particularly to FIG. 1, there is shown a baby crib 10, having a head end 11 and a foot end 12, as well as sides 13*a* and 13*b*. The crib sides and ends are formed by a plurality of vertical bars 14 having gaps or spaces 15 therebetween. The spaces 15 are made sufficiently small, that is, vertical bars 14 are located sufficiently close to each other, so to prevent any possibility of a baby's head passing between the bars and causing injury to the child. The crib also includes mattress support 16, on which rests mattress 17. The mattress is generally covered with a crib sheet or other linens which are well known and are not shown. The ensemble may also include various head protecting pads, sometimes called bumpers, which are placed inside the crib and secured to the vertical bars in a manner that is well known.

The device of the present invention is shown generally at 20 and comprises an end wall 21 from which a plurality of tines 22 project. The tines 22 are wedge shaped, that is, substantially right triangular in cross-section so that each has its tallest portion at the end wall, illustrated at 23, and its shortest portion at the tips 24. The bottom edge 25 of each tine is horizontal (the base of the right triangle) while the top edge 26 (the hypotenuse of the triangle) slopes downwardly from the end wall 21 to the tips 24 to yield the wedge shape. As shown in the drawings the triangular cross-section has been truncated at the tips so that the tips are blunt rather than sharp. The exact shape of the tips can be either blunt or sharp depending upon the material from which the device is made. It is preferred to have the tips somewhat blunt or truncated as shown to give the tips more strength and resistance to breaking or chipping off.

The vertical height of the end wall 21 can vary depending upon the precise height one wishes to raise the head end of the mattress. It is important that the head end be raised sufficiently to be effective in elevating the child's head slightly, but not be raised so much that sleeping becomes awkward and uncomfortable or that restraining or supportive means need to be added to keep the child in place. It is generally preferred to raise the mattress about four to six inches, and it is preferred that the height of end wall 21 be about five inches. It is preferred that tines 22 be about fourteen to sixteen inches in length so that they well extend comfortably and firmly under the mattress. When the height of the end wall is about five inches and the length of the tines is about sixteen inches, the device will have a slope of about 17.5 degrees, which produces a satisfactory elevation of the head end of the mattress for supporting the baby in an optimum position for sleep with head congestion. The slope can be varied somewhat, but a slope in the range of about 15 degrees to about 20 degrees is desirable. Such a slope is sufficiently gentle so that no special means are need for holding the baby in place on top of the mattress.

Figure 2:
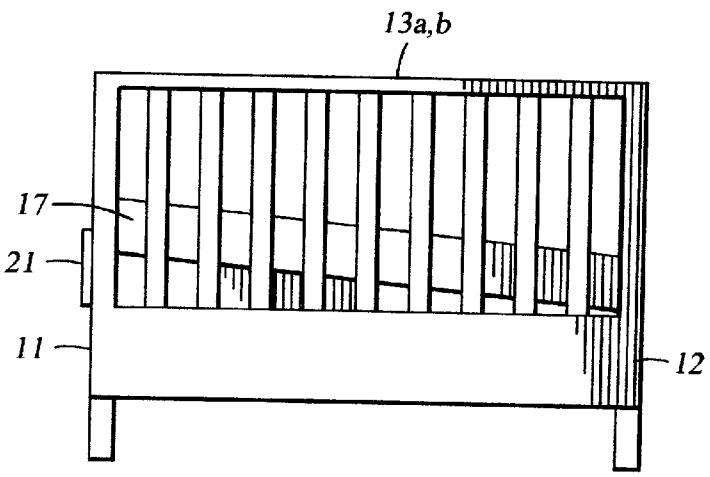
FIG. 2 is a side elevation view of the crib with the device in place.
Figure 3:
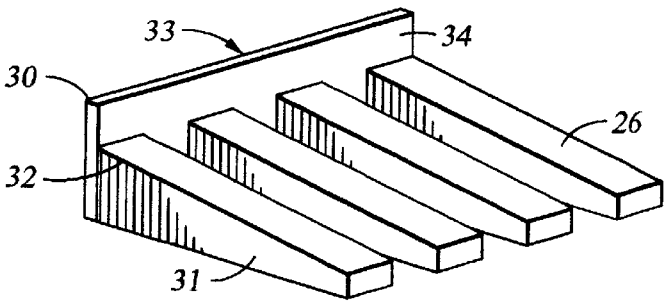
FIG. 3 is a perspective view of one embodiment of the device alone.

As shown in FIG. 2, the device is used by merely inserting the tines 22 between the vertical bars 14 of the crib and under the mattress 17, between the mattress 17 and the mattress support 16, pushing it firmly into place. Once in place, the head end of the mattress 17 will be raised an amount approximately equal to the height of the end wall 21, or about five inches in the preferred embodiment.

The device may employ a convenient plurality of tines, shown in the drawings as four tines which is believed to be optimal. The number of tines can be varied to meet the specific design of the head portion of the crib, keeping in mind that the overall width of the device should be sufficient to give the mattress 16 lateral stability, that is, the mattress should not rock from side to side with the device inserted, even if the baby is lying away from the center of the mattress and toward one side or the other. I have found that a width of about twelve inches works well. This width is achieved by using four tines, each of which has a width to allow them to fit in the space between vertical bars that is designed to be sufficiently narrower to prevent a baby's head from entering the space. If a particular crib design had narrower spaces between the bars 14, it may be desired to utilize a greater number of tines in order to achieve an optimal overall width and sufficient strength for the device.

The device could be manufactured from a variety of materials, but I prefer to manufacture it from a rigid foam or other lightweight plastic material, so that it is light in weight but has sufficient strength and rigidity to enable it to be pushed under the crib mattress repeatedly with ease without crumpling or breaking.

Figure 4:
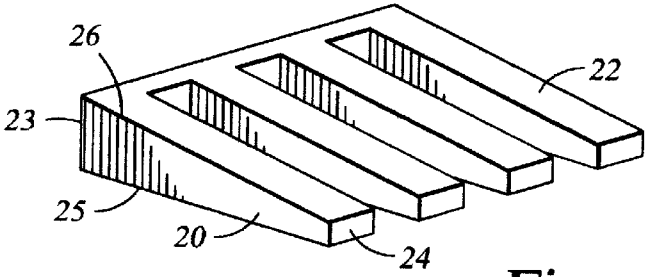
FIG. 4 is a perspective view of another embodiment of the invention.

A somewhat modified form of the invention is illustrated in FIG. 4, wherein the height of the end wall 30 is somewhat greater than the height of the tall end 32 of the tines 31 (the height dimension of the right triangular cross-section). The addition of the top portion 34 to the end wall 30 can give the device a somewhat more "finished" appearance when in place, and provides a surface 34 for gripping while inserting or removing the device from the crib. If desired a decorative motif can be applied to the outermost side 33 of the end wall 30. In this embodiment, it is preferred to keep the height of the tines at 32 at about five inches, even though the overall height of the end wall 30 will be somewhat greater than that.

In order to use the device, one simply raises the head end of the crib mattress slightly by reaching through the bars 14 and then inserting the tips 24 of the tines 22 into the space thus created. Once the tips 24 are in place, it is simple to push the remainder of the length of the tines 22 under the mattress such that the top edge 26 slides against the bottom surface of the mattress 17 thereby raising the head end of the mattress in the process. With the device fully in place, the head end of mattress 17 will be raised an amount substantially equal to the height of the tines 22. The amount the end of the mattress 17 is raised can be varied somewhat by varying the distance the tines 22 are inserted under the mattress. Thus if less elevation of the mattress is desired, the tines 22 can be inserted under the mattress less than their full length.

The entire process can be accomplished from outside of the sleeping area of the crib, with no requirement for reaching inside the crib or raising the mattress more that an inch or two to get the tines started in position The process is sufficiently simple and easy that it can be done by one person and can even be done while the baby is lying on the mattress itself Thus, if the baby begins to cough or exhibit other signs of congestion after it has been put down to sleep, the device can be inserted at that time, often without even disturbing or waking the sleeping baby.

While the invention has been described in detail to enable those skilled in the art to make and practice the same, it will be understood that various modifications can be made by those skilled in the art without departing from the spirit or scope of the invention.

I claim:

1. An apparatus for raising the end of a crib mattress, said apparatus comprising an end wall portion having a plurality of tines having a substantially right triangular cross-section attached thereto and projecting horizontally therefrom, each of said tines having a width enabling it to fit between the vertical bars of a baby crib, each of said tines having its maximum height at the end wall portion and its minimum height at its tip, such that insertion of said tines under said crib mattress raises the end of said mattress a distance substantially equal to the height of said tines.

2. The device according to claim 1 having four tines, each of which has a maximum height of five inches and a length substantially equal to sixteen inches.

3. A device for raising one end of a crib mattress, said device comprising a wedge, said wedge being divided into a plurality of parallel, spaced apart sections, each of said sections being adapted to fit between the vertical bars of a crib and under the crib mattress to raise one end of said mattress an amount substantially equal to the height of said wedge.

4. The device according to claim 3 wherein said plurality of sections is four.

5. The device according to claim 3 wherein the height of said wedge is substantially five inches.

* * * * *